US008487523B2

(12) United States Patent
Jones et al.

(10) Patent No.: US 8,487,523 B2
(45) Date of Patent: Jul. 16, 2013

(54) REDUCED WATTAGE GAS DISCHARGE LAMP

(75) Inventors: Brian D. Jones, Lexington, KY (US); Craig Boyce, Versailles, KY (US)

(73) Assignee: OSRAM SYLVANIA Inc., Danvers, MA (US)

( * ) Notice: Subject to any disclaimer, the term of this patent is extended or adjusted under 35 U.S.C. 154(b) by 0 days.

(21) Appl. No.: 13/107,953

(22) Filed: May 15, 2011

(65) Prior Publication Data

US 2012/0248966 A1 Oct. 4, 2012

Related U.S. Application Data

(60) Provisional application No. 61/469,385, filed on Mar. 30, 2011.

(51) Int. Cl.

| | |
|---|---|
| ***H01J 5/16*** | (2006.01) |
| ***H01J 1/62*** | (2006.01) |
| ***H01J 9/00*** | (2006.01) |

(52) U.S. Cl.

USPC ..... 313/486; 313/487; 252/301.4 P; 252/301.4 R; 445/23

(58) Field of Classification Search

USPC ..... 313/486, 637, 483, 485, 489, 639, 313/640, 572, 576, 487; 445/23–25; 252/301.4 P, 301.4 R

See application file for complete search history.

(56) References Cited

U.S. PATENT DOCUMENTS

| | | | | |
|---|---|---|---|---|
| 3,898,511 | A | 8/1975 | Johnson et al. | |
| 3,988,633 | A | 10/1976 | Shurgan et al. | |
| 5,604,396 | A | 2/1997 | Watanabe et al. | |
| 6,583,566 | B1 * | 6/2003 | Jin et al. | 313/637 |
| 2007/0170863 | A1 | 7/2007 | Jansma | |
| 2008/0278073 | A1 | 11/2008 | Beers et al. | |
| 2009/0309482 | A1 * | 12/2009 | Srivastava et al. | 313/487 |

FOREIGN PATENT DOCUMENTS

JP 2000-223075 A 8/2000

OTHER PUBLICATIONS

Yang Ki Sung, International Search Report and Written Opinion of the International Searching Authority, Sep. 25, 2012, pp. 1-8, Korean Intellectual Property Office, Daejeon Metropolitan City, Republic of Korea.

* cited by examiner

*Primary Examiner* — Joseph L Williams
(74) *Attorney, Agent, or Firm* — Shaun P. Montana

(57) ABSTRACT

A reduced wattage gas discharge lamp and method of making same. The gas discharge lamp includes a light transmissive envelope with an inner surface, having a light scattering reflective layer disposed thereon. A phosphor layer is coated on an inner surface of the light scattering reflective layer. A discharge-sustaining gaseous mixture is retained inside the light-transmissive envelope. The discharge-sustaining gaseous mixture includes at least 88% argon, by volume, at a low pressure. An electrode is located within the light-transmissive envelope. The electrode is capable of providing an electric discharge to trigger a reaction within the light-transmissive envelope to cause the lamp to emit light. The remainder of the discharge-sustaining gaseous mixture is substantially neon, at a low pressure. The low pressure is about 3.6 Torr.

7 Claims, 2 Drawing Sheets

REDUCED WATTAGE GAS DISCHARGE LAMP

CROSS-REFERENCE TO RELATED APPLICATION(S)

The present application claims priority of U.S. Provisional Application Ser. No. 61/469,385, filed Mar. 30, 2011, naming Brian D. Jones and Craig Boyce as inventors, and entitled REDUCED WATTAGE GAS DISCHARGE LAMP, the entire contents of which are hereby incorporated by reference.

TECHNICAL FIELD

The present invention relates to lighting, and more specifically, to low pressure gas discharge lamps.

BACKGROUND

As the cost of consuming energy rises ever higher, everyone continues to seek light sources that use less and less energy while providing a similar (or greater) amount of lumens than conventional, inefficient, energy-hogging lamps. Simply replacing energy inefficient incandescent lamps with energy efficient lamps, be they fluorescent, halogen, or solid state light sources (e.g., LED, OLED, etc.), results in energy savings and thus reduced energy costs. However, many have already taken this step.

SUMMARY

To achieve further energy savings over those already provided by energy-efficient lamps requires that lamp manufacturers make these already-efficient lamps even more energy efficient.

Embodiments as described herein provide a reduced wattage gas discharge lamp, with a particular fill gas mixture, at a particular pressure, that utilizes less energy that a similarly-sized full wattage gas discharge lamp, while providing a similar lumen output to the full wattage lamp. Indeed, in some embodiment, the lumen output of the reduced wattage lamp is the same as that of the full wattage lamp. For example, a reduced wattage two-foot T5 fluorescent lamp, utilizing the fill gas mixture and pressure disclosed herein, creates a lumen output that is comparable to a full wattage two-foot T5 fluorescent lamp, while using less energy than the full wattage lamp.

In an embodiment, there is provided a gas discharge lamp. The gas discharge lamp includes: a light-transmissive envelope; a light scattering reflective layer disposed on an inner surface of the light-transmissive envelope; a phosphor layer coated on an inner surface of the light scattering reflective layer; a discharge-sustaining gaseous mixture retained inside the light-transmissive envelope, the discharge-sustaining gaseous mixture comprising at least 88% argon, by volume, at a low pressure; and an electrode located within the light-transmissive envelope, wherein the electrode is capable of providing an electric discharge to trigger a reaction within the light-transmissive envelope to cause the lamp to emit light.

In a related embodiment, the discharge-sustaining gaseous mixture may be at a low pressure of about 3.6 Torr. In another related embodiment, the discharge-sustaining gaseous mixture may include about 90% argon and 10% neon, by volume, at a low pressure. In yet another related embodiment, the discharge-sustaining gaseous mixture may be at a low pressure of about 3.6 Torr. In still another related embodiment, the phosphor layer may include a blended triphosphor system of red, green, and blue color-emitting rare earth phosphors. In further related embodiment, the phosphor layer may include jumbo particles ranging in size between about five and ten microns.

In yet still another related embodiment, the discharge-sustaining gaseous mixture may include at least two gases, wherein a first gas of the at least two gases may be argon. In a further related embodiment, an amount of the first gas may be between about 88% argon, by volume, and 92% argon, by volume. In another further related embodiment, a second gas of the at least two gases may be neon. In a further related embodiment, an amount of the second gas may be between about 8% neon, by volume, and 12% neon, by volume.

In another embodiment, there is provided a method of making a low pressure gas discharge lamp including mercury. The method includes: connecting a light-transmissive envelope with an electrode, the electrode to provide a discharge, the light-transmissive envelope having an inner surface; disposing a light scattering reflective layer on the inner surface of the light-transmissive envelope, the light scattering reflective layer having an inner surface; coating a phosphor layer on the inner surface of the light scattering reflective layer; dispensing mercury inside the light-transmissive envelope; and supplying a gaseous mixture inside the light-transmissive envelope, the gaseous mixture comprising at least 88% argon, by volume, with a remainder of the gaseous mixture comprises neon, the gaseous mixture at a low pressure.

In a related embodiment, supplying may include supplying a gaseous mixture inside the light-transmissive envelope, the gaseous mixture comprising about 90% argon, by volume, and about 10% neon, by volume, the gaseous mixture at a pressure of about 3.6 Torr. In another related embodiment, coating a phosphor layer may include coating a phosphor layer comprising a blended triphosphor system of red, green, and blue color-emitting rare earth phosphors on the inner surface of the light scattering reflective layer.

BRIEF DESCRIPTION OF THE DRAWINGS

The foregoing and other objects, features and advantages disclosed herein will be apparent from the following description of particular embodiments disclosed herein, as illustrated in the accompanying drawings in which like reference characters refer to the same parts throughout the different views. The drawings are not necessarily to scale, emphasis instead being placed upon illustrating the principles disclosed herein.

DETAILED DESCRIPTION

Low pressure gas discharge lamps come in a variety of shapes and sizes. Though embodiments are described herein with reference to a particular shape (linear) and particular sizes (two-foot and three-foot T5), a low pressure gas discharge lamp according to the invention is not so limited to that particular shape and those particular sizes. For example, in some embodiments, the low pressure gas discharge lamp may be bent in a circular shape. Alternatively, or additionally, the low pressure gas discharge lamp may be substantially linear in shape while including a bent and/or semi-bent portion.

Further, in other embodiments, the low pressure gas discharge lamp may take other shapes, such that any shape is possible within the knowledge of persons having ordinary skill in the art as described herein.

Figure 1:
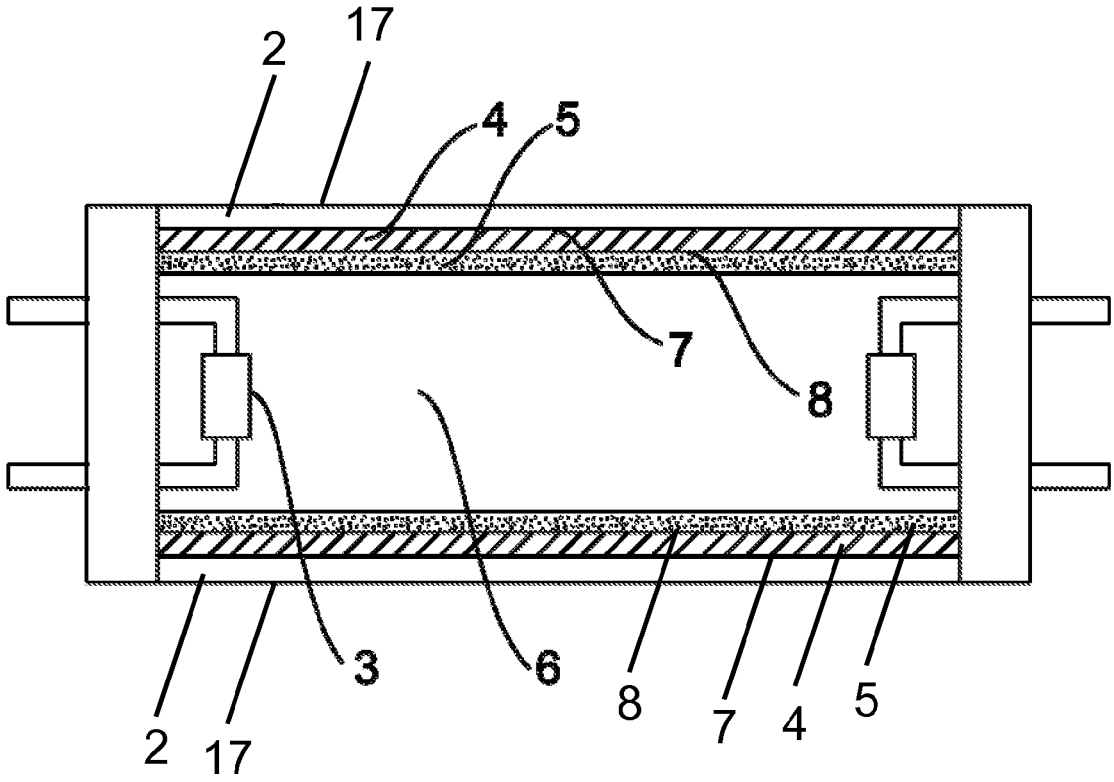
FIG. 1 shows a cross-sectional component view of a gas discharge lamp including a gaseous mixture of at least 88% argon by volume, according to embodiments disclosed herein.

A low pressure gas discharge lamp 1 as shown in a cross-sectional view in FIG. 1 includes a light-transmissive envelope 2 and at least one electrode 3. The at least one electrode 3 provides a discharge within the light-transmissive envelope 2, as is known in the art, to cause a reaction inside the light-transmissive envelope 2, resulting in the lamp 1 generating light. Some embodiments include more than one electrode 3. In embodiments where there is a plurality of electrodes, the plurality of electrodes may be arranged on one end of the light-transmissive envelope 2. Alternatively, the plurality of electrodes may be arranged on opposing ends of the light-transmissive envelope 2.

The light-transmissive envelope 2 is made from any material that is capable of containing the components of a low pressure gas discharge lamp 1, as described herein, and that is capable of transmitting light. In some embodiments, the light-transmissive envelope 2 is made from glass. Alternatively, or additionally, in some embodiments the light-transmissive envelope 2 is made from a composite of materials including glass. The light-transmissive envelope 2 includes an inner surface 7 and an outer surface 17. The outer surface 17 of the light-transmissive envelope 2 is visible when looking at the lamp 1. In some embodiments, the outer surface 17 of the light-transmissive envelopes 2 includes a protective coating 18 that prevents spreading of the material and/or materials comprising the outer surface 17 should the outer surface 17 break. The inner surface 7 of the light-transmissive envelope 2 contains at least two layers. A light scattering reflective layer 4 is disposed on the inner surface 7 of the light-transmissive envelope 2. In addition to scattering light generated within the low pressure gas discharge lamp 1, the light scattering reflective layer 4, in some embodiments, serves as a mercury barrier. In some embodiments, the light scattering reflective layer 4 is formed from fumed alumina. Fumed alumina has a high ultraviolet (UV) light reflectance and good visible light transmittance, the importance of which is described in greater detail below. Of course, any known light scattering reflective material may be used, regardless of its UV light reflectance properties. In some embodiments, the light scattering reflective layer 4 is disposed on the entire inner surface 7 of the light-transmissive envelope 2. Alternatively, in other embodiments, the light scattering reflective layer 4 is disposed on a portion of the inner surface 7 of the light-transmissive envelope 2.

In addition to the light scattering reflective layer 4, a phosphor layer 5 is also coated on the inner surface 7 of the light-transmissive envelope 2. More specifically, the phosphor layer 5 is coated on an inner surface 8 of the light scattering reflective layer 4. The phosphor layer 5 serves to achieve a variety of spectral power distributions and colors for the light emitted by the low pressure gas discharge lamp 1. In some embodiments, the phosphor layer 5 is a blended triphosphor system of red, green, and blue color-emitting rare earth phosphors, having a "jumbo" particle size ranging between about five and ten microns. As is known in the art, the measured particle size of a phosphor and/or combination of phosphors varies depending on the type of machine used to measure the particle size. Alternatively, or additionally, other variations of phosphor and/or phosphors are used. In some embodiments, the phosphor layer 5 is coated on the entire inner surface 8 of the light scattering reflective layer 4. Alternatively, in other embodiments, the phosphor layer 5 is coated on a portion of the inner surface 8 of the light scattering reflective layer 4.

The light scattering reflective layer 4 reflects any UV light not initially captured by the phosphor layer 5 back into the phosphor layer 5, thereby maximizing the effectiveness of the phosphor layer 5. As stated above, the light scattering reflective layer 4 may also serve as a barrier layer so as to prevent migration of mercury into the material of the light-transmissive envelope 2 during usage of the lamp 1. By preventing migration of mercury, graying and lowered efficiency of the material of the light-transmissive envelope 2 are reduced, and service life and efficiency of the low pressure gas discharge lamp 1 are increased.

As stated above, the low pressure gas discharge lamp 1 contains mercury, which is dispensed inside of the light-transmissive envelope 2, as is well known in the art. In some embodiments, the mercury is a mercury vapor. Alternatively, or additionally, the mercury may be present in the form of an amalgam. A discharge-sustaining gaseous mixture 6 is also supplied inside of the light-transmissive envelope 2. The discharge-sustaining gaseous mixture 6 is at a low pressure, and is comprised of at least two gases. The discharge-sustaining gaseous mixture 6 contains at least about 88% argon, by volume. In some embodiments, the discharge-sustaining gaseous mixture 6 contains at most about 92% argon, by volume. That is, the amount of argon in the discharge-sustaining gaseous mixture 6 ranges from about 88% by volume to about 92% by volume. The remainder of the discharge-sustaining gaseous mixture 6 is neon, which thus ranges from about 12% by volume to about 8% by volume. In a preferred embodiment, the discharge-sustaining gaseous mixture 6 is about 90% argon by volume and about 10% neon by volume, with a tolerance of about plus or minus 2% by volume for both gases. In some embodiments, the amount of argon in the discharge-sustaining gaseous mixture 6 ranges from 88% by volume to 92% by volume, inclusive. In such embodiments, the remainder of the discharge-sustaining gaseous mixture 6 is neon, which thus ranges from 12% by volume to 8% by volume, inclusive.

The discharge-sustaining gaseous mixture 6 is maintained at a pressure of about 3.6 Torr, with a tolerance of plus or minus about 0.2 Torr. Thus, the discharge-sustaining gaseous mixture 6 is kept at a low pressure, ranging from about 3.4 Torr to about 3.8 Torr. In some embodiments, the discharge-sustaining gaseous mixture 6 is maintained at a pressure of 3.6 Torr. In some embodiments, the discharge-sustaining gaseous mixture is maintained at a pressure between 3.4 Ton and 3.8 Torr, inclusive. The discharge-sustaining gaseous mixture 6 is at a conventional fill temperature as known in the art, such as but not limited to 25 degrees Celsius, and in some embodiments, to about 25 degrees Celsius. This temperature fluctuates during operation of the lamp 1, such that peak lumen output of the lamp 1 may at occur, for example, a temperature between about 35 degrees Celsius and about 40 degrees Celsius. Of course, the temperature corresponding to the peak lumen output of the lamp 1 will also fluctuate depending on the size of the lamp 1, among other characteristics.

The combination of the argon-neon discharge-sustaining gaseous mixture 6, according to the ranges and/or specific values described herein, maintained within the pressure ranges and/or specific values described herein, results in a reduced wattage low pressure gas discharge lamp 1 that provides a lumen output comparable to a similarly sized low pressure gas discharge lamp operating using more watts. Thus, while a full wattage three foot T5 lamp typically operates at about 39 Watts, a three foot T5 lamp including the argon-neon discharge-sustaining gaseous mixture described herein operates at about 35 Watts, a wattage reduction of approximately ten percent, with a comparable lumen output of approximately 3500 lumens for each lamp. Similarly, a full wattage two foot T5 lamp typically operates at about 24 Watts, while a two foot T5 lamp including the argon-neon discharge-sustaining gaseous mixture described herein operates at about 21 Watts, a wattage reduction of slightly greater than ten percent, with a comparable lumen output of approximately 2000 lumens for each lamp.

Figure 2:
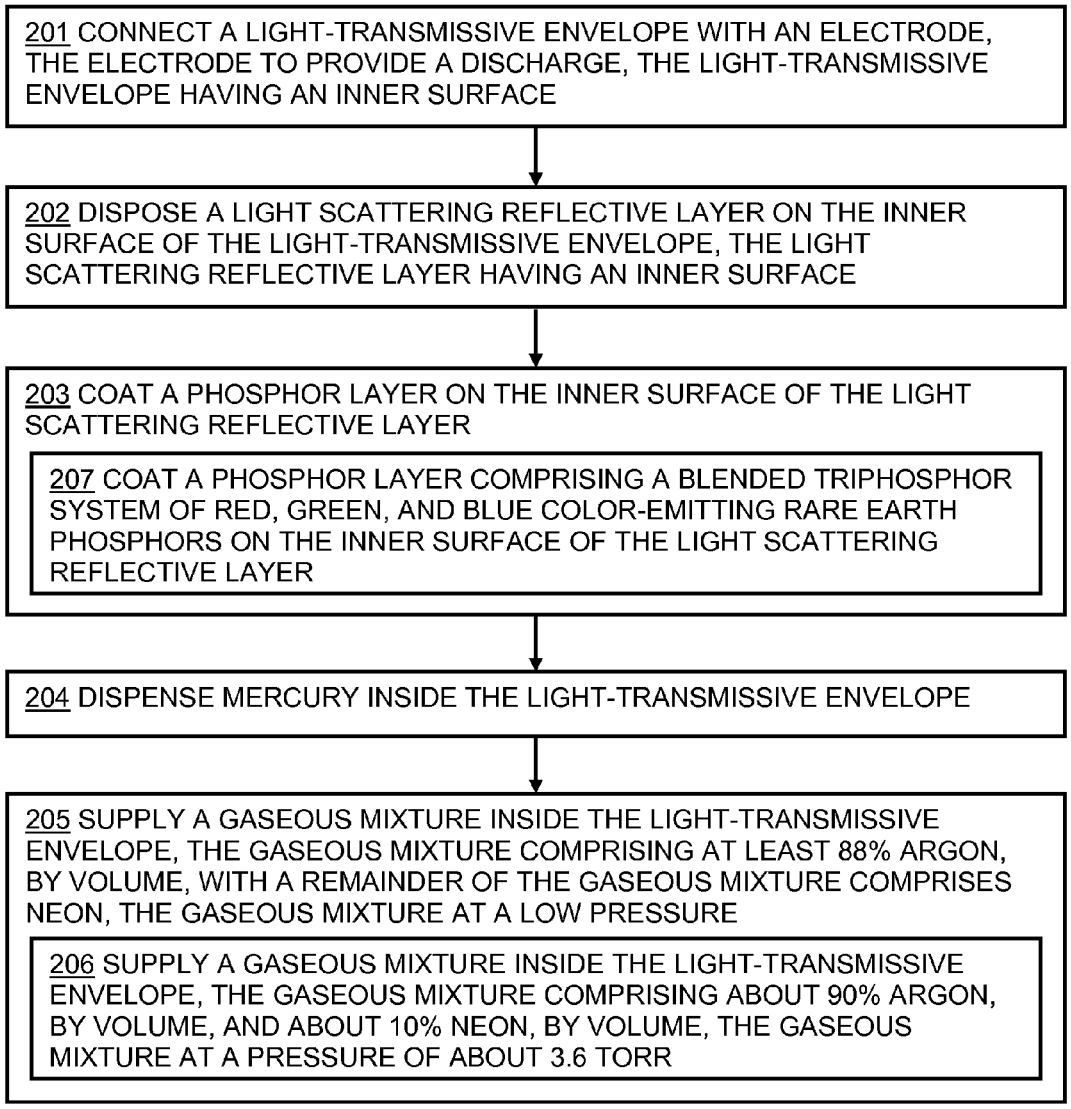
FIG. 2 illustrates a method of making a low pressure gas discharge lamp including mercury according to embodiments disclosed herein.

FIG. 2 shows a flowchart for a method of making the low pressure gas discharge lamp as described herein. It will be appreciated by those of ordinary skill in the art that unless otherwise indicated herein, the particular sequence of steps described is illustrative only and may be varied without departing from the spirit of the invention. Thus, unless otherwise stated, the steps described below are unordered, meaning that, when possible, the steps may be performed in any convenient or desirable order.

In some embodiments, the low pressure gas discharge lamp as described herein may be made as follows. First, a light-transmissive envelope is connected with an electrode, step 201. The connection may be a direct connection, such that the light-transmissive envelope and the electrode touch each other, or may be an indirect connection, such that one or more other components are located between the light-transmissive envelope and the electrode. The light-transmissive envelope may take any shape, as described above. In a preferred embodiment, the light-transmissive envelope has a diameter of ⅝ of an inch, and the low pressure gas discharge lamp has a length of either two feet or three feet. The electrode provides a discharge, when connected to electricity (e.g., via a ballast). As described above, the light-transmissive envelope includes an inner surface. A light scattering reflective layer is then disposed on the inner surface of the light-transmissive envelope, step 202. The light scattering reflective layer itself has an inner surface. In addition to scattering light generated within the low pressure gas discharge lamp, the light scattering reflective layer, in some embodiments, serves as a mercury barrier. In some embodiments, the light scattering reflective layer is formed from fumed alumina. Fumed alumina has a high ultraviolet (UV) light reflectance and good visible light transmittance, the importance of which is described in greater detail below. Of course, any known light scattering reflective material may be used, regardless of its UV light reflectance properties. In some embodiments, the light scattering reflective layer is disposed on the entire inner surface of the light-transmissive envelope. Alternatively, in other embodiments, the light scattering reflective layer is disposed on a portion of the inner surface of the light-transmissive envelope.

A phosphor layer is coated on the inner surface of the light scattering reflective layer, step 203. In some embodiments, the phosphor layer is a blended triphosphor system of red, green, and blue color-emitting rare earth phosphors, having a "jumbo" particle size ranging between about five and ten microns, which is coated on the inner surface of the light scattering reflective layer, step 207. As is known in the art, the measured particle size of a phosphor and/or combination of phosphors varies depending on the type of machine used to measure the particle size. Alternatively, or additionally, other variations of phosphor and/or phosphors are used. In some embodiments, the phosphor layer is coated on the entire inner surface of the light scattering reflective layer. Alternatively, in other embodiments, the phosphor layer is coated on a portion of the inner surface of the light scattering reflective layer.

Next, mercury is dispensed inside the light-transmissive envelope, step 204, according to any technique known in the art for dispensing mercury within a lamp. In some embodiments, the amount of mercury dispensed is about 1.8 mg of mercury, on average. A discharge-sustaining gaseous mixture is then supplied inside the light-transmissive envelope, step 205. The discharge-sustaining gaseous mixture comprises at least 88% argon, by volume, at a low pressure, and in some embodiments, comprises at most 92% argon, by volume, at a low pressure. The remainder of the discharge sustaining gaseous mixture is neon, which thus ranges from about 8% by volume to about 12% by volume. The discharge sustaining gaseous mixture is maintained at a low pressure, which in some embodiments is about 3.6 Torr, with a tolerance of about plus or minus 0.2 Torr. In some embodiments, the discharge-sustaining gaseous mixture is supplied inside the light transmissive envelope, where the gaseous mixture comprises about 90% argon, by volume, and about 10% neon, by volume, the gaseous mixture at a pressure of about 3.6 Torr, step 206.

Unless otherwise stated, use of the words "about" and/or "substantially" may be construed to include a precise relationship, condition, arrangement, orientation, and/or other characteristic, and deviations thereof as understood by one of ordinary skill in the art, to the extent that such deviations do not materially affect the disclosed methods and systems.

Throughout the entirety of the present disclosure, use of the articles "a" and/or "an" and/or "the" to modify a noun may be understood to be used for convenience and to include one, or more than one, of the modified noun, unless otherwise specifically stated. The terms "comprising", "including" and "having" are intended to be inclusive and mean that there may be additional elements other than the listed elements.

Elements, components, modules, and/or parts thereof that are described and/or otherwise portrayed through the figures to communicate with, be associated with, be connected to, and/or be based on, something else, may be understood to so communicate, be associated with, be connected to, and or be based on in a direct and/or indirect manner, unless otherwise stipulated herein.

Although the methods and systems have been described relative to a specific embodiment thereof, they are not so limited. Obviously many modifications and variations may become apparent in light of the above teachings. Many additional changes in the details, materials, and arrangement of parts, herein described and illustrated, may be made by those skilled in the art.

What is claimed is:

1. A gas discharge lamp comprising:

a light-transmissive envelope;

a light scattering reflective layer disposed on an inner surface of the light-transmissive envelope;

a phosphor layer coated on an inner surface of the light scattering reflective layer;

a discharge-sustaining gaseous mixture retained inside the light-transmissive envelope, the discharge-sustaining gaseous mixture comprising at least more than 95% argon, by volume, the remainder neon, by volume, at a low pressure; and an electrode located within the light-transmissive envelope, wherein the electrode is capable of providing an electric discharge to trigger a reaction within the light-transmissive envelope to cause the lamp to emit light.

2. The gas discharge lamp of claim 1, wherein the discharge-sustaining gaseous mixture is at a low pressure of about 3.6 Torr.

3. The gas discharge lamp of claim 1, wherein the phosphor layer comprises a blended triphosphor system of red, green, and blue color-emitting rare earth phosphors.

4. The gas discharge lamp of claim 3, wherein the phosphor layer is comprised of jumbo particles ranging in size between at least more than six microns and about ten microns.

5. A method of making a low pressure gas discharge lamp including mercury, the method comprising:

connecting a light-transmissive envelope with an electrode, the electrode to provide a discharge, the light-transmissive envelope having an inner surface;

disposing a light scattering reflective layer on the inner surface of the light-transmissive envelope, the light scattering reflective layer having an inner surface;

coating a phosphor layer on the inner surface of the light scattering reflective layer;

dispensing mercury inside the light-transmissive envelope; and supplying a gaseous mixture inside the light-transmissive envelope, the gaseous mixture comprising at least more than 95% argon, by volume, with a remainder of the gaseous mixture comprises neon, the gaseous mixture at a low pressure.

6. The method of claim 5 wherein supplying comprises:

supplying a gaseous mixture inside the light-transmissive envelope, the gaseous mixture comprising at least more than 95% argon, by volume, remainder neon, by volume, the gaseous mixture at a pressure of about 3.6 Torr.

7. The method of claim 5, wherein coating a phosphor layer comprises:

coating a phosphor layer comprising a blended triphosphor system of red, green, and blue color-emitting rare earth phosphors on the inner surface of the light scattering reflective layer.

* * * * *